United States Patent [19]

Humphrey

[11] 4,155,207

[45] May 22, 1979

[54] CABLE-WRAPPED FIBERGLASS REINFORCED PLASTIC BIN

[75] Inventor: Frederick H. Humphrey, Markham, Canada

[73] Assignee: Metal-Cladding, Inc., North Tonawanda, N.Y.

[21] Appl. No.: 872,041

[22] Filed: Jan. 25, 1978

[51] Int. Cl.[2] ..... E04H 7/22; E06B 3/54

[52] U.S. Cl. ..... 52/248; 52/224

[58] Field of Search ..... 52/247, 248, 194, 169.7, 52/309.9, 245, 224

[56] References Cited

U.S. PATENT DOCUMENTS

| | | | |
|---|---|---|---|
| 3,470,656 | 10/1969 | Clements | 52/247 |
| 3,530,628 | 9/1970 | Ferris et al. | 52/248 |
| 3,885,364 | 5/1975 | Lankheet | 52/169.7 |

FOREIGN PATENT DOCUMENTS

| | | | |
|---|---|---|---|
| 2309509 | 9/1973 | Fed. Rep. of Germany | 52/309.9 |

*Primary Examiner*—James L. Ridgill, Jr.

*Attorney, Agent, or Firm*—Sommer & Sommer

[57] ABSTRACT

An improved bin is adapted to receive and store materials having fluid properties, such as liquids and granular materials. The bin is made of a fiberglass reinforced plastic material, and has a circular bottom arranged to rest on a foundation, and a cylindrical side wall bonded to a marginal portion of the bottom and extending upwardly therefrom. A cable has its lower end suitably anchored proximate the bottom, has its intermediate length helically wound around the outside of the side wall, and has its upper end suitably anchored proximate the top of the side wall. The improved bin also includes a plurality of vertical members, also formed of a fiberglass reinforced plastic material, spaced circumferentially around the inner surface of the side wall. Each vertical member defines with the side wall a sealed tubular cavity extending upwardly from the bottom. A bearing member, such as concrete, is arranged within each tubular cavity and engages the bottom to receive and support a vertical load transferred from the side wall.

10 Claims, 28 Drawing Figures

Fig. 5.
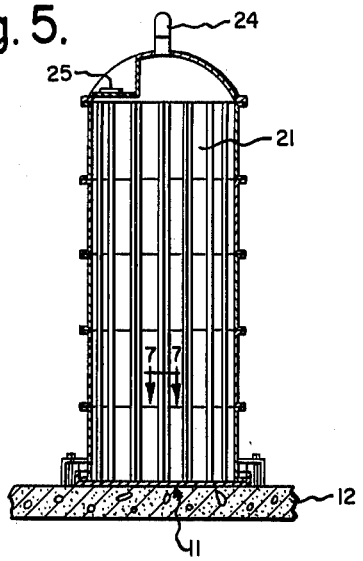
Fig. 6.
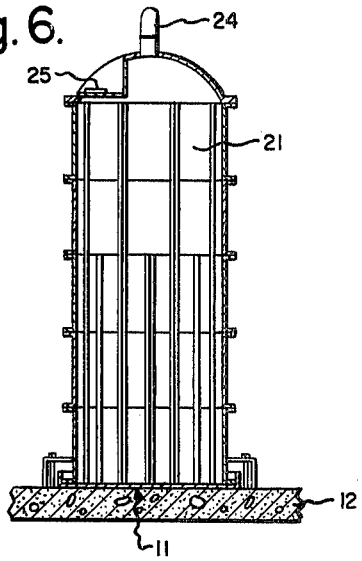
Fig. 7.
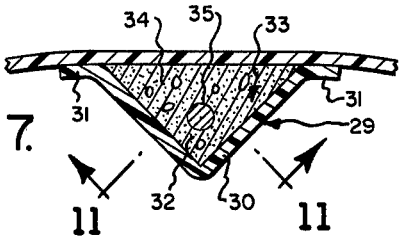
Fig. 8.
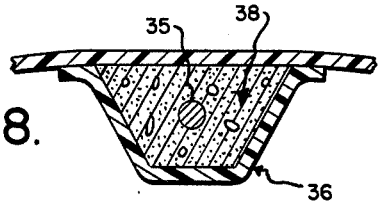
Fig. 9.
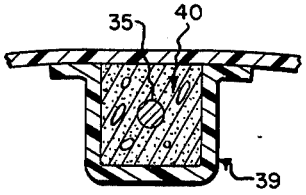
Fig. 10.
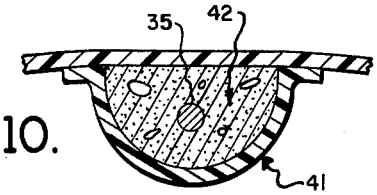
Fig. 12.
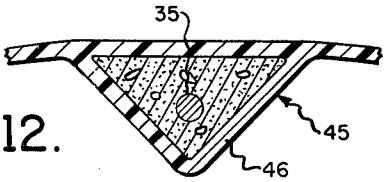
Fig. 11.
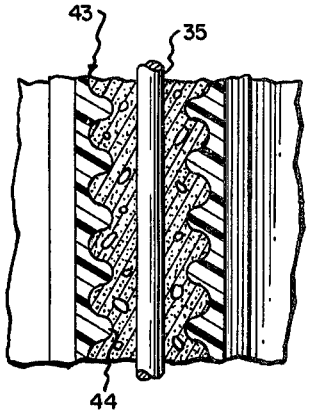
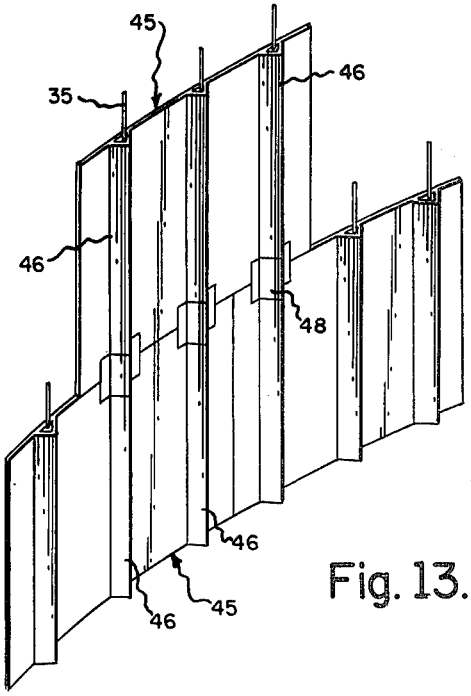
Fig. 13.

CABLE-WRAPPED FIBERGLASS REINFORCED PLASTIC BIN

BACKGROUND OF THE INVENTION

1. Field of the Invention

The present invention relates generally to the field of tanks, bins and silos for storing materials having fluid properties, and more particularly to an improved bin having a cable-wrapped thin and flexible side wall made of fiberglass reinforced plastic material, which is reinforced to withstand substantial vertical pressures.

2. Description of the Prior Art

Many types of bins and silos suitable for storing granular materials have, of course, been heretofore developed. Most of these have been formed of a suitable metal or concrete because such materials are relatively rigid and have high moduli of elasticity. One example of such known silo construction is shown in U.S. Pat. No. 3,307,311.

However, in recent years, it has become common practice to treat agricultural products with formic acid to kill animal and bacterial life. Unfortunately, formic acid is known to attack both steel and concrete.

In a collateral field, it has been known to form large capacity liquid storage tanks from a thin-walled fiberglass reinforced plastic (FRP) material, reinforced by a cable helically wound around the side wall. While such FRP material is not attacked by formic acid, the use of such tanks has been limited to liquids because such tanks have heretofore not been designed to resist dynamic vertical loads.

The principal problem in adapting such cable-wrapped FRP tanks to store granular materials has been in the area of designing such structures to withstand vertical loads. Unlike a liquid, which does not exert a vertical load on the side wall of a tank, granular materials do exert such vertical loads. The problem is further complicated by the possibility that such granular materials may become undermined during a bottom-unloading operation, the effect of which may be to leave a relatively large mass of suspended material supported only by the side wall.

The side wall of such an FRP tank could be reinforced to support vertical loads by the placement of certain columns about the outside of the tank, but this would interfere with the operation of the side wall-encircling cable.

Various aspects of such cable-wrapped FRP tanks, designed to store liquids, are shown in U.S. Pat. Nos. 3,025,992, 3,917,104, and 3,990,600.

SUMMARY OF THE INVENTION

The present invention provides an improved cable-wrapped thin-walled FRP bin which is adapted to receive and store a material.

The improved bin broadly comprises a substantially horizontal circular bottom formed of an FRP material and resting on a suitable support; a substantially cylindrical vertical side wall structure also formed of an FRP material and extending upwardly from a marginal portion of the bottom; and a plurality of vertical members also formed of an FRP material and spaced about the inner surface of the side wall. Each of the vertical members has, in transverse cross-section, a central convex portion extending into the bin, and flange portions extending laterally from the convex portion in opposite directions. The flange portions are bonded to the side wall so that the vertical members define therewith a plurality of hollow sealed tubes extending upwardly from the tank bottom. The bin also includes a bearing member arranged within each of the tubes and arranged to thrustingly engage the tank bottom, these bearing members being operative to receive and support a vertical load transferred from the side wall.

Preferably, the inner surface of the vertical members has an undulating shape to provide an interlock with the bearing members.

Accordingly, one general object of the present invention is to provide an improved cable-wrapped thin-walled FRP bin which is adapted to receive and store a granular material.

Another object is to provide an improved FRP bin of the type described, which is designed to withstand large vertical loads in the side wall if a quantity of such granular material is undermined during an unloading operation.

Still another object is to provide an improved bin or silo which is formed of a fiberglass reinforced plastic material having a high degree of corrosion resistance.

These and other objects and advantages will become apparent from the foregoing and ongoing specification, the drawings, and the appended claims.

BRIEF DESCRIPTION OF THE DRAWINGS

FIG. 2A is a schematic view of an FRP bin or tank filled with a liquid to the height of its side wall.

FIG. 2B is a graph showing the lateral pressure exerted by the stored liquid on the side wall of the tank shown in FIG. 2A, as a function of tank elevation.

FIG. 2C is a graph showing the static vertical pressure in the side wall of the tank shown in FIG. 2A due to the weight of the supported structure as a function of tank elevation.

FIG. 2D is a graph showing the vertical pressure in the side wall of the tank shown in FIG. 2A due to the stored liquid, as a function of tank elevation, this graph being left blank since a liquid does not exert a downward force on the side wall.

FIG. 2E is a graph showing the total vertical pressure in the side wall of the tank shown in FIG. 2A as a function of tank elevation, this curve being obtained by superimposing the curves shown in FIGS. 2C and 2D.

FIG. 3A is a schematic view of the FRP bin shown in FIG. 2A, but filled with corn grain to the height of its side wall.

FIG. 3B is a graph showing the lateral pressure exerted by the stored grain on the side wall of the bin shown in FIG. 3A, as a function of bin elevation.

FIG. 3C is a graph showing the static vertical pressure in the side wall of the bin shown in FIG. 3A due to the weight of the supported structure as a function of bin elevation, this graph being identical to FIG. 2C.

FIG. 3D is a graph showing the vertical pressure in the side wall of the bin shown in FIG. 3A due to the corn grain as a function of bin elevation.

FIG. 3E is a graph showing the total vertical pressure in the side wall of the bin shown in FIG. 3A as a function of bin elevation, this curve being obtained by superimposing the curves shown in FIGS. 3C and 3D.

FIG. 4A is a schematic view of the FRP bin shown in FIG. 3A, but showing the grain as having been undermined by an unloading operation such that a mass of grain remains suspended between the 50 and 60 foot elevation levels.

FIG. 4B is a graph showing the lateral pressure exerted by the suspended mass of grain on the side wall of the bin shown in FIG. 4A, as a function of bin elevation.

FIG. 4C is a graph showing the static vertical pressure in the side wall of the bin shown in FIG. 4A due to the weight of the supported structure, as a function of bin elevation, this graph being identical to FIGS. 2C and 3C.

FIG. 4D is a graph showing the vertical pressure in the side wall of the bin shown in FIG. 4A due to the weight of the suspended mass of grain as a function of bin elevation, it having been assumed that such weight is distributed evenly to the side wall between the 50 and 60 foot elevation levels.

FIG. 4E is a graph showing the total vertical pressure in the side wall of the bin shown in FIG. 4A as a function of bin elevation, this curve having been obtained by superimposing the curves shown in FIGS. 4C and 4D.

FIG. 5 is a reduced fragmentary vertical sectional view thereof, taken generally on line 5—5 of FIG. 1, showing one form of the improved bin wherein the vertical members extend the full height of the side wall.

FIG. 6 is a view similar to FIG. 5, but showing another form of the improved bin wherein the vertical members are of staggered vertical heights.

FIG. 7 is a greatly enlarged fragmentary horizontal sectional view thereof, taken generally on line 7—7 of FIG. 5, and showing the vertical and bearing members in transverse cross-section.

FIG. 8 is a view similar to FIG. 7, but showing a first modified embodiment of the vertical and bearing members.

FIG. 9 is a view similar to FIG. 7, but showing a second modified embodiment of the vertical and bearing members.

FIG. 10 is a view similar to FIG. 7, but showing a third modified embodiment of the vertical and bearing members.

FIG. 11 is a fragmentary vertical sectional view, taken generally on line 11—11 of FIG. 7, showing the interlocking undulations on the inside of the vertical member to prevent slippage thereof relative to the associated bearing member.

FIG. 12 is a view generally similar to FIG. 7, but showing a vertical member as having been formed integrally with a side wall segment.

FIG. 13 is a perspective interior view of a side wall segment on one tier arranged to abut two adjacent segments of the next lower tier such that the integrally-formed vertical members will be aligned with one another.

DESCRIPTION OF THE PREFERRED EMBODIMENTS

Figure 1:
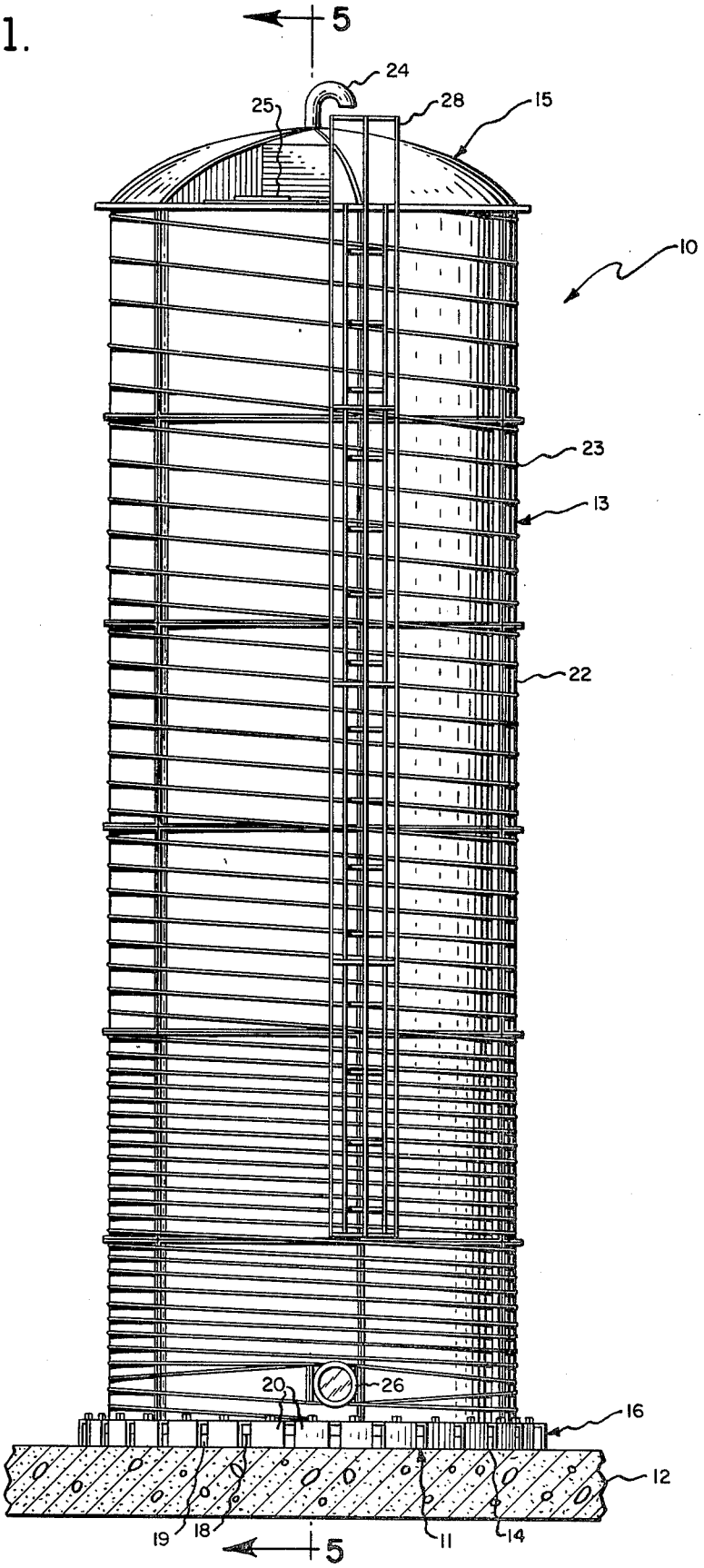
FIG. 1 is a front elevational view of an improved cable-wrapped fiberglass reinforced plastic (FRP) bin incorporating the present invention.

At the outset, it should be clearly understood that like reference numerals are intended to identify the same elements and/or structure consistently throughout the several drawing figures, as such elements and/or structure may be further described or explained by the entire written specification of which this detailed description is an integral part.

Referring now to the several drawing figures, and more particularly to FIG. 1 thereof, the invention broadly provides an improved bin, of which the presently preferred embodiment is generally indicated at 10, which is particularly adapted to receive and store a material having fluid properties (i.e., the ability to flow). As used herein, the term "bin" is intended to broadly refer to an enclosure for storing a solid material. Hence, a "silo", which is commonly regarded as meaning an enclosure for storing silage or other agricultural products, is a species of a "bin", as is a "tank", which is commonly used to describe an enclosure for liquids. Similarly, the term "granular material" refers to a material which is composed of small solid particles, and a "powdered material" is a species of a "granular material". Hence, a "material having fluid properties" includes both liquids and such "granular materials".

In FIG. 1, the improved bin 10 is depicted as including a substantially horizontal circular bottom 11 (FIGS. 5 and 6) resting on a concrete support or foundation 12, a substantially cylindrical vertical side wall structure 13 bonded to a peripheral marginal portion 14 of the bottom and extending upwardly therefrom, and a domed top or cover 15. Preferably, the bottom, the side wall structure, and the cover are each formed of a suitable fiberglass reinforced plastic (FRP) material. In cross-section, such FRP material may typically include alternate layers of high strength woven roving and 1½ oz. fibrous mat, and one or more inner layers of surfacing mat, such as C-glass, these several layers being bonded together by a suitable resin, such as polyester, epoxy, phenolic, furfuryl alcohol, vinylester, or some other suitable plastic, to provide a high degree of corrosion resistance to materials and vapors within the tank.

A lower portion of the side wall structure is shown as being provided with a bottom ring girder, generally indicated at 16, which is designed to secure the bin to the foundation against the application of an overturning moment, such as a wind or seismic load. The structure and operation of this bottom ring girder 16 is more fully disclosed in U.S. Pat. No. 3,917,104, the aggregate disclosure of which is hereby incorporated by reference. Suffice it to say here that the bottom ring girder broadly includes a pair of radially-extending annular upper and lower flanges 18, 19 extending outwardly from the side wall structure, and a plurality of anchorage devices 20 secured to the foundation and arranged to slidably engage the upper flange 18.

Since the modulus of elasticity of such FRP material is relatively low, being on the order of $1.0\times10^6$ pounds per square inch (psi) in tension and $1.25\times10^6$ psi in compression, the side wall structure 13 of the bin must be further strengthened to resist the hoop stress exerted by a stored granular material acting on the inner surface 21 (FIGS. 5 and 6) of the side wall structure. To this end, a steel cable having a greater modulus of elasticity, typically on the order of $21\times10^6$ psi, has its lower end suitably anchored (not shown) proximate the bin bottom, has its intermediate length helically wound around the outer surface 22 of the side wall structure such that the vertical spacing between adjacent cable convolutions 23 increases with height above the bottom, and has its upper end suitably secured (not shown) proximate the cover. This type of cable-wrapped FRP construction is broadly known in this art, although heretofore used only for tanks containing liquids, and is more fully disclosed in U.S. Pat. No. 3,025,992, the aggregate disclosure of which is also hereby incorporated by reference.

The bin cover 15 is shown as being formed of six pie-shaped arcuate segments, suitably secured together. Cover 15 is shown further provided with a central goose neck vent 24, and an access or inspection port 25. The side wall structure 13 is shown as including a lower manway 26, and a ladder structure 28.

The particular bin depicted in FIG. 1 is designed to store shelled corn, and has an inside diameter of twenty feet. The height of the side wall structure is about sixty feet, and the nominal radial thickness of the side wall is about one-quarter of an inch.

THE PROBLEM OF VERTICAL BIN LOADS

Figures 2, 3, 4:
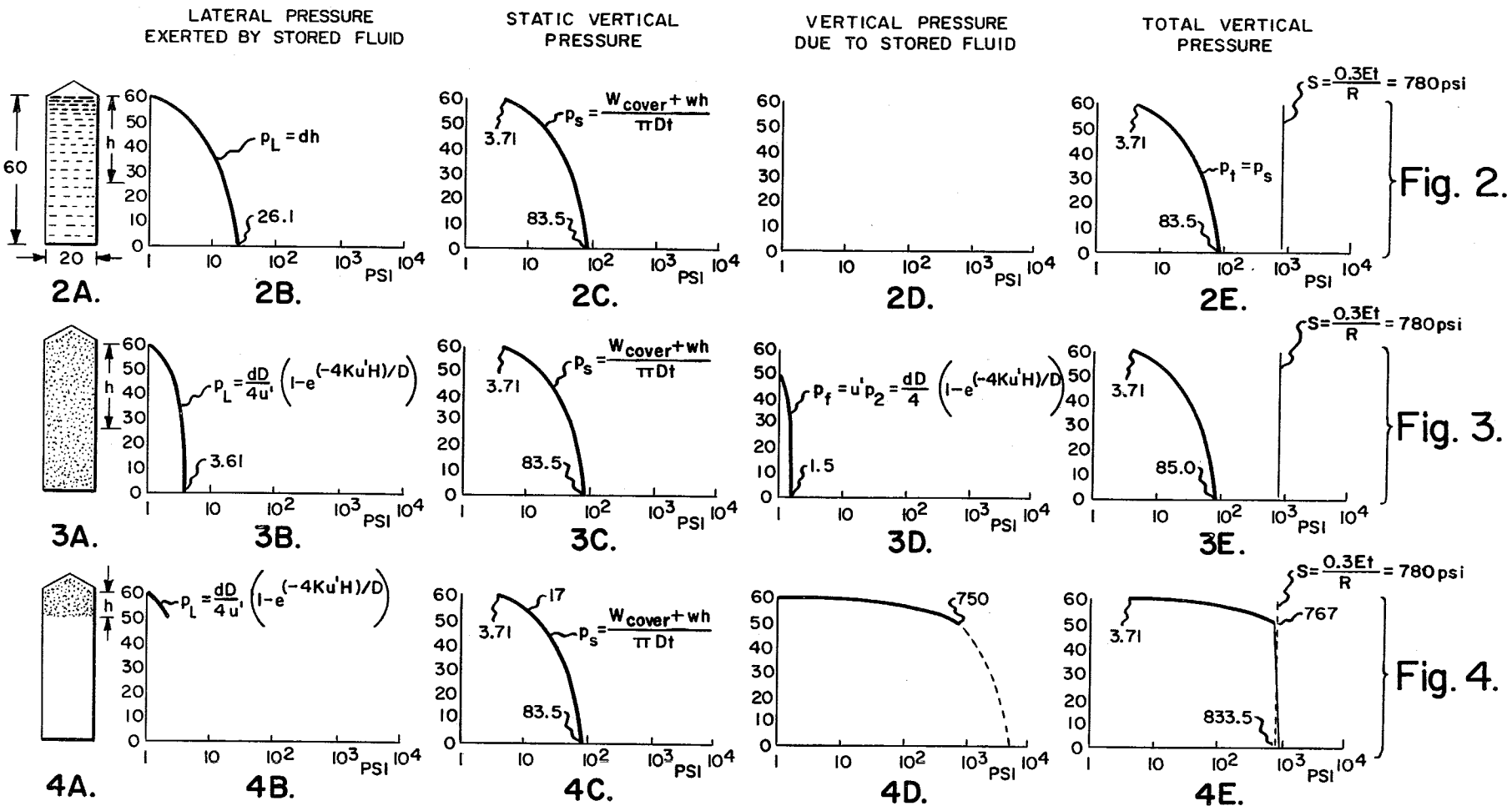
FIG. 2 illustrates the various lateral and vertical pressures in the side wall of the tank depicted in FIG. 2A.
FIG. 3 illustrates the various lateral and vertical pressures in the side wall of the tank or bin depicted in FIG. 3A.
FIG. 4 illustrates the various lateral and vertical pressures in the side wall of the bin depicted in FIG. 4A.

The problem of vertical bin loads in the side wall structure is graphically illustrated in FIGS. 2–4.

The FRP tank or bin schematically depicted in each of FIGS. 2A, 3A and 4A, has an inside diameter (D) of 20 feet, a side wall height (H) of 60 feet, a side wall thickness (t) of ¼ inch, and a cover or top. In FIG. 2A, the tank is shown filled with water. In FIG. 3A, the tank is filled with a granular material, specifically shelled corn. In FIG. 4A, some corn grain has been removed from the lower portion of the bin shown in FIG. 3A, leaving an undermined or suspended quantity between the 50 and 60 foot elevation levels.

Referring now to FIG. 2B, the lateral pressure ($p_L$) exerted by the 60 foot head of stored water on the side wall may be calculated according to the formula:

$$p_L = dh$$

where d=density of water; and h=station depth below the surface of the water.

This head of the stored water exerts the greatest lateral pressure ($p_L$) on the side wall adjacent the tank bottom, at which location $p_L=26.1$ psi.

Referring now to FIG. 3B, the lateral pressure ($p_L$) exerted by the stored grain on the side wall is given by Janssen's formula:

$$p_L = \frac{dD}{4u'}(1-e^{(-4Ku'H)/D})$$

where:

d=density of grain=45 lbs./ft$^3$;

D=internal bin diameter;

$\phi$=angle of repose of grain;

K=ratio of lateral to vertical internal pressure=$(1-\sin\phi)/(1+\sin\phi)$;

u'=coefficient of friction of corn grain on side wall=0.423;

H=depth of grain; and e=Naperian log base.

Again, the maximum lateral pressure ($p_L$) exerted by the grain on the side wall occurs adjacent the tank bottom, at which location $p_L=3.61$ psi.

Referring now to FIG. 4A, if a quantity of grain has been undermined by an unloading operation, the lateral pressure ($p_L$) exerted by the remaining suspended mass of grain on the side wall will act only between the 50 and 60 foot levels. However, whereas the depth of the stored grain (H) was 60 feet in FIG. 3B, such depth is only 10 feet in FIG. 4B. Hence, the maximum lateral pressure exerted by the suspended mass of grain on the side wall structure will occur at the 50 foot level, at which location $p_L=2.08$ psi.

Referring now to FIGS. 2C, 3C and 4C, the static vertical pressure ($p_s$) at any station depth (h) will be equal to the total weight of the tank above the point being considered, divided by the cross-sectional area of the side wall. Assuming that the cover weighs 700 lbs., and that the weight of the side wall and cable (assuming uniform cable spacing) is equally distributed along the height of the tank, the weight (W) of the tank above any station depth (h) will be equal to weight of the cover plus the weight of the side wall and cable above such station, or, $$W_h = W_{cover} + wh$$

where w=weight of side wall and cable per unit of depth=251 lbs./ft

The static vertical pressure ($p_s$) at any station depth (h) may now be calculated:

$$p_s = \frac{\text{weight}}{\text{area}} = \frac{W_{cover} + wh}{\pi Dt}$$

Thus, the greatest static vertical pressure ($p_s$) in the side wall will occur adjacent the bottom, at which location $p_s=83.5$ psi. Inasmuch as the structure of the tank or bins shown in FIGS. 2A, 3A and 4A is identical, the static pressure curves shown in FIGS. 2C, 3C and 4C are identical because the static vertical pressure of the tank or bin itself is independent of the stored fluid, be it a liquid or a granular material having quasi-fluid properties.

The vertical pressures ($p_f$) exerted by the respective stored fluids on the side walls are shown in FIGS. 2D, 3D and 4D.

Referring to FIG. 2D, the stored water will not exert any downward vertical force on the side wall. Hence, there is no vertical pressure, and FIG. 2D has been left blank.

In FIG. 3D, the vertical pressure ($p_f$) in the side wall at any station depth attributable to the stored grain may be calculated according to Rankine's development:

$$p_f = u'p_L$$

where:

$p_L$=lateral pressure (Janssen's formula); and u'=coefficient of friction of the stored corn grain on side wall=0.423

Or, $$p_f = u'p_L = dD/4(1-e^{(-4Ku'H)/D})$$

This function is shown in FIG. 3D. As expected, the greatest vertical load pressure ($p_f$) in the side wall will exist adjacent the tank bottom, at which location $p_f=1.53$ psi.

Assume now, that the bin shown in FIG. 3A is unloaded from the bottom, leaving an undermined mass of material frictionally held between the 50 and 60 foot levels (FIG. 4A). The vertical pressurs ($p_f$) attributable to this suspended mass of grain will be zero at the 60 foot level. Assuming that the weight of the material above a station depth (h) is uniformly applied to the side wall, the weight (W) of the suspended grain above such station depth (h) may be calculated according to the formula (ignoring the angle of repose):

$$W=\pi R^2 hd$$

In any event, at a station depth immediately beneath the 50 foot level, the side wall will support the entire weight of the suspended mass. In other words, at h=10, $$p_f = \frac{\text{weight}}{\text{area}} = \frac{\pi R^2 (10) d}{\pi Dt} = 750 \text{ psi}$$

This function is shown in FIG. 4D, and has been continued by the dotted line for illustrative purposes to demonstrate how the vertical load pressure would increase if larger quantities of such material were to remain suspended.

The total vertical pressure ($p_T$) in the side wall at any station depth will be equal to the sum of the static vertical pressure at such depth, and the vertical pressure attributable to the load at such depth. The total vertical pressures at different station depths are respectively illustrated in FIGS. 2E, 3E and 4E.

In the case of water (FIG. 2E), the liquid exerts no vertical load on the side wall. Hence, the total vertical pressure ($p_T$) at any station depth will be equal to the static vertical pressure ($p_s$) at such depth. Hence, FIG. 2E is identical to FIG. 2C.

When the bin is completely filled with grain, (FIG. 3A) the static vertical pressure ($p_s$) is much greater than the vertical load pressure ($p_s$). The curves shown in FIGS. 3C and 3D may be superimposed to obtain the curve shown in FIG. 3E. Thus, adjacent the tank bottom, $$p_T=p_s+p_f=83.5+1.5=85.0 \text{ psi.}$$

Referring now to the undermined bin (FIG. 4A), the curve shown in FIG. 4E may be obtained by superimposing the curves shown in FIGS. 4C and 4D. Thus, at the 50 foot elevation, $$p_T=p_s+p_f=17+750=767 \text{ psi}$$

At the bottom of the tank, $$p_T=p_s+p_f=83.5+750=833.5 \text{ psi.}$$

However, the critical buckling stress (S) of the tank is calculated according to the formula:

$$S=0.3Et/R$$

where

E=modulus of elasticity; ($E_{FRP}=1.25\times10^6$ psi)

t=thickness of side wall;

R=internal radius of bin side wall.

For the tank or bin shown in FIGS. 2A, 3A and 4A, $$S = \frac{0.3\,(1.25 \times 10^6)\,(0.25)}{(10)\,(12)} = 780 \text{ psi}$$

In FIG. 4E, since the maximum vertical pressure adjacent the bottom of the tank ($p_T$=833.5 psi), is a greater than the critical buckling stress (S=780 psi), the tank shown in FIG. 4E will fail by buckling. However, if the tank were completely filled with grain (FIG. 3A), the maximum vertical pressure in the side wall would be about 85.0 psi, this being only about 11% of the critical buckling stress (S=780 psi). In other words, when the tank is completely filled with grain (FIG. 3A), the factor of safety is about 9. The factor of safety for the tank filled with water (FIG. 2A) is slightly greater than 9.

From the foregoing, it can be seen that vertical pressures in the side wall of an FRP tank do not pose a design problem unless a mass of material becomes suspended. However, if the tank is filled with grain, for example, and is undermined during an unloading operation such that a mass of the material remains suspended above the bottom, the weight of such suspended material will produce high vertical pressures in the side wall which may approach or exceed the critical buckling stress of the tank.

By comparison, if the tank shown in FIG. 4A had been made of steel ($E=30\times10^6$ psi), the critical buckling stress would have been:

$$S = \frac{0.03Et}{R} = \frac{(0.3)\,(30 \times 10^6)\,(0.25)}{(10)\,(12)} = 18{,}750 \text{ psi.}$$

In the foregoing example, the total weight of the FRP side wall (7540 lbs.) and cover (700 lbs.) was about 8240 lbs. Since the ratio of the density of steel (490 lbs./ft$^3$) to the density of FRP (96 lb./ft.$^3$) is about 5.1, if the tank had been made of steel, the maximum vertical static pressure would have been about (5.1)(83.5)=426 psi. Hence, the total vertical pressure (FIG. 4A) adjacent the tank bottom for such a steel tank, would have been:

$$P_{tmax}=p_{smax}=426+750=1176 \text{ psi.}$$

Therefore, a steel tank of equal dimensions and loaded as shown in FIG. 4A would not have failed. Indeed, the factor of safety for such a steel tank, as expressed by the ratio between the critical buckling stress (S=18,750 psi) and the maximum vertical pressure ($p_T$=1176 psi), would have been about 17.45. This dramatically illustrates that substantially different problems are faced in designing FRP tanks to withstand larger vertical loads, than for steel.

THE IMPROVED STRUCTURE (FIGS. 5–13)

Referring now to FIGS. 5, 7 and 11, the improved bin 10 is shown as further including a plurality of vertical members, severally indicated at 29, each formed of a fiberglass reinforced plastic material of the type heretofore described, and spaced circumferentially about the inner surface of the side wall.

As best shown in FIG. 7, each of these vertical members 29 has, in transverse cross-section, a central convex portion 30 extending inwardly of the bin, and flange portions 31 extending laterally outwardly therefrom in opposite directions so as to be positioned adjacent the side wall. These two flange portions 31, 31 are bonded to the inner surface of the side wall structure so as to define therewith a vertically-elongated hollow tube bounding a sealed tubular cavity 32 therewithin extending upwardly from the tank bottom.

Still referring principally to FIG. 7, the improved bin 10 is shown as further including a bearing member, generally indicated at 33, arranged within each tubular cavity 32 to thrustingly engage the tank bottom and operative to receive and support a vertical load transferred from the side wall structure.

In the several preferred embodiments disclosed in FIGS. 5–12, the several vertical members 29 are bonded to the inside surface of the bin after the side wall has been assembled. Thereafter, concrete 34 is poured into the tubular cavities 32 to provide the bearing members. In FIG. 7, a vertical reinforcing rod 35 is shown embedded in the concrete bearing member. When the concrete is initially poured into the tubular cavities, these reinforcing rods may be suitably manipulated to agitate the concrete and eliminate air pockets, thereby insuring its even distribution throughout the vertical extent of cavities 32. Of course, such reinforcing rod may be left in place as the concrete hardens for reinforcement of the associated bearing member.

Depending largely on the particular material which the bin is designed to store, each of the vertical members 29 may extend substantially the full height of the side wall, as shown in FIG. 5. Alternatively, and particularly in the case of grannular materials having a relatively low fluid density, such vertical members may be of different heights, and preferably staggered with respect to one another, as shown in FIG. 6, or may be of uniform height but having a vertical extent less than the height of the side wall (not shown).

With respect to the cross-sectional shape of the vertical members 29, these should define tubular cavities of sufficient area that the bearing member will support its proportionate share of the vertical load. Beyond this, it is desirable that the bearing members be of sufficient strength to resist inward flexure of the side wall. The minimum cross-sectional area of such bearing members may be readily calculated by persons skilled in this art.

The present invention expressly contemplates that the vertical members may define with the side wall, tubular cavities having different cross-sectional shapes. In FIG. 7, the vertical member 29 is shown as having a substantially V-shaped transverse cross-section so as to define a substantially triangular tubular cavity. In FIG. 8, a first modified vertical member 36 is shown as having a different transverse cross-section so as to define a substantially trapezoidal tubular cavity 38. In FIG. 9, a second modified vertical member 39 is shown as having a substantially U-shaped transverse cross-section so as to define a substantially rectangular tubular cavity 40. Finally, in FIG. 10, a third modified vertical member 41 is shown as having a generally half-round transverse cross-section so as to define a substantially half-round tubular cavity 42. While these various shapes depicted in FIGS. 7–10 are illustrative of different types of vertical members, the present invention expressly contemplates that other shapes and configurations may be used.

Referring now to FIG. 11, the preferred embodiment of bin 10 is shown as further including interlock means, generally indicated at 43, operatively acting between each vertical member 29 and its associated bearing member 33 for insuring that a vertical load on the side wall will be transferred to the bearing members, and for preventing relative motion therebetween. In the preferred embodiments herein illustrated and described, the cavity-facing internal surface 44 of the vertical members 29 has an undulating shape along its vertical extent to provide such interlock means. In practical effect, this undulating inner surface 44 provides a plurality of shoulder-type connections between the vertical member and the concrete bearing member so as to transfer and distribute the vertical load from the side wall to the bearing members. One particular advantage of such an undulating cross-section is that it serves to distribute the transferred load, and thereby to relieve stress concentrations as might occur if conventional fasteners were used. However, the specific form of the interlock means is not necessarily limited to the specific shape illustrated in FIG. 11, but may assume other shapes achieving like objects and advantages.

It should be further noted that the vertical members are arranged on the inside of the bin so as to not interfere with the intended function and operation of the external hoop stress-absorbing cable. At the same time, the concrete bearing members are contained within sealed tubes so as to isolate such bearing members from fluids or vapors within the tank which might otherwise attack and corrode concrete.

In the embodiments heretofore described, the vertical members were bonded to the bin after the side wall had been erected. However, this type of construction need not invariably obtain. For example, since large bins are typically formed as cylindrical segments subsequently bonded to one another as the side wall is erected, the vertical members may be formed integrally with such segments, if desired. In FIG. 12, such a segment 45 is shown as provided with an integrally formed V-shaped vertical member 46, functionally similar to that shown in FIG. 7. In FIG. 13, the segment of one tier is shown as abutting two segments of the next lower tier so that the tubular cavities will be vertically aligned with one another. Of course, the joints between the various vertical members 46 may be sealed by means of suitable battens 48 bonded to the inside of the segments.

Another unique feature of such an FRP bin is that the side wall structure affords a measure of thermal insulation, where as steel is commonly recognized as being a thermal conductor. Indeed, the unit coefficient of thermal conductivity for FRP material is about 1.5 Btu/hr.-ft.$^2$ (° F./in.) as compared with about 300–324 for steel. Hence, moist materials within an FRP tank are less likely to be subjected to ambient freezing temperatures, than in the case of steel bins.

In some applications, it may be desirable to omit the provision of an FRP bottom for the tank, and to mount the side wall structure directly on the support or foundation.

Of course, the improved bin could be used as a tank to store a liquid, if desired.

Therefore, while several presently preferred embodiments of the improved bin have been shown and described, persons skilled in this art will readily appreciate that various additional changes and modifications may be made without departing from the spirit of the invention which is defined in the following claims.

What is claimed is:

1. An upstanding bin adapted to receive and store a material, comprising:

a support having a substantially horizontal surface;

a substantially cylindrical vertical side wall structure formed of a fiberglass reinforced plastic material and extending upwardly from said support;

a plurality of vertical members formed of a fiberglass reinforced plastic material and spaced circumferentially about the inner surface of said side wall structure, each of said members having in transverse cross-section a central convex portion extending into said bin from the inner surface of said side wall structure and having flange portions extending laterally away from said convex portion in opposite directions, said flange portions being bonded to said side wall structure, each of said members defining with said side wall structure a hollow tube completely arranged within said bin and extending upwardly from said support; and a bearing member arranged within each of said tubes and arranged to thrustingly engage said support, said bearing members being arranged to support a vertical load transferred from said side wall structure.

2. A bin as set forth in claim 1 and further comprising:

interlock means acting between said members and said bearing columns for preventing relative movement therebetween.

3. A bin as set forth in claim 1 wherein said bearing columns are concrete.

4. A bin as set forth in claim 1 wherein each of said tubes has a substantially triangular transverse cross-sectional shape.

5. A bin as set forth in claim 1 wherein each of said tubes has a substantially rectangular transverse cross-sectional shape.

6. A bin as set forth in claim 1 wherein each of said tubes has a substantially trapezoidal transverse cross-sectional shape.

7. A bin as set forth in claim 1 wherein each of said tubes has a substantially half-round transverse cross-sectional shape.

8. A bin as set forth in claim 1 wherein the vertical extent of some of said bearing members is greater than the vertical extent of others of said bearing members.

9. A bin as set forth in claim 1 wherein said side wall structure is formed from a plurality of cylindrical segments, and wherein said vertical members are bonded to each of said segments such that the tubes of said segments will be vertically aligned when said side wall structure is assembled.

10. A bin as set forth in claim 1 and further comprising:

a substantially horizontal circular bottom formed of a fiberglass reinforced plastic material and resting on said support; and wherein said side wall structure is bonded to a marginal portion of said bottom and extends upwardly therefrom; and wherein said hollow sealed tube extends upwardly from said bottom.

* * * * *